United States Patent [19]

Bray

[11] 4,176,719

[45] Dec. 4, 1979

[54] HEAT SENSITIVE RELEASE DEVICES

[75] Inventor: Geddes A. Bray, Manchester, England

[73] Assignee: Mather & Platt Limited, Manchester, England

[21] Appl. No.: 970,074

[22] Filed: Dec. 15, 1978

Related U.S. Application Data

[63] Continuation of Ser. No. 776,057, Mar. 9, 1977, abandoned.

[30] Foreign Application Priority Data

Mar. 12, 1976 [GB] United Kingdom ..... 9915/76

[51] Int. Cl.[2] ..... A62C 37/08

[52] U.S. Cl. ..... 169/39

[58] Field of Search ..... 169/37, 38, 39, 40, 169/42

[56] References Cited

U.S. PATENT DOCUMENTS

| | | | |
|---|---|---|---|
| 758,522 | 4/1904 | Garrett | 169/39 |
| 2,502,754 | 4/1950 | Rowley | 169/38 |
| 3,583,492 | 6/1971 | Vorkapich | 169/39 |
| 3,625,289 | 12/1971 | Gloeckler | 169/39 |
| 3,770,063 | 11/1973 | Juliano | 169/39 |
| 4,029,150 | 6/1977 | Goodsell, Jr. | 169/39 |

*Primary Examiner*—Robert W. Saifer

*Attorney, Agent, or Firm*—Sughrue, Rothwell, Mion, Zinn and Macpeak

[57] ABSTRACT

A heat sensitive release device, for example a sprinkler, comprises two relatively movable components, for example a yoke and valve member. A collapsible strut system is located between the relatively movable components. The collapsible strut system includes a catch element having opposed wings between which is held a heat sensitive element, for example a double ended heat sensitive cartridge. The collapsible strut system also includes a lever fulcrummed on one of the components and a strut engaged between the other component and the lever adjacent the fulcrum. The strut or the lever bears against the heat sensitive element while the lever or strut is connected to or integral with the catch element.

7 Claims, 12 Drawing Figures

HEAT SENSITIVE RELEASE DEVICES

This is a Continuation of application Ser. No. 776,057, filed Mar. 9, 1977 and now abandoned.

The present invention relates to a heat sensitive release device for example, an automatic sprinkler for deluge fire fighting equipment, a heat detector, a multiple spray control valve, or a fusible link.

According to the present invention there is provided a heat sensitive release device comprising two relatively movable components, a collapsible strut system for location between the components and including a catch element having two opposed wings between which is held a heat sensitive element, a lever fulcrummed on one of the components, a strut engaging at one end on the other component and at its other end on the lever adjacent the fulcrum, one of the strut and the lever bearing against the heat sensitive element while the other is operatively associated with the catch element.

It is considered that this heat sensitive release device provides the following advantages:

1. The manufacturing tolerances of the components of the heat sensitive element do not have to relate in a critical manner to the working tolerances of the lengths or other dimensions and angles of the members of the collapsible strut system, or vice versa, but only to the distances between the wings of the catch element.

2. The load on the heat sensitive element is halved for a particular design of collapsible strut system as compared with existing systems.

This being so, the dimensions of the heat sensitive element can be reduced for reasons of cost, convenience and appearance, or more importantly the collapsible strut system may be shortened to reduce the size of the release device.

3. An impediment is preferably provided between the lever and the strut to prevent lever movement towards the strut and removal of the heat sensitive element from the catch element.

The provision of an impediment to prevent cartridge removal from the catch element is desirable to making the components of the collapsible strut system rigid. A degree of springiness in the components of the strut system is desirable as this enables them to fly apart easily when the cartridge is released from the catch element.

Embodiments of the present invention will now be described by way of example with reference to the accompanying drawings, in which.

Figure 1:
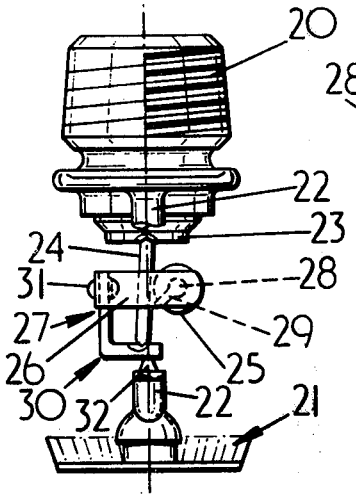
FIG. 1 is a side elevation view of an automatic sprinkler with yoke partially removed and incorporating a collapsible strut system according to the present invention.
Figure 2:
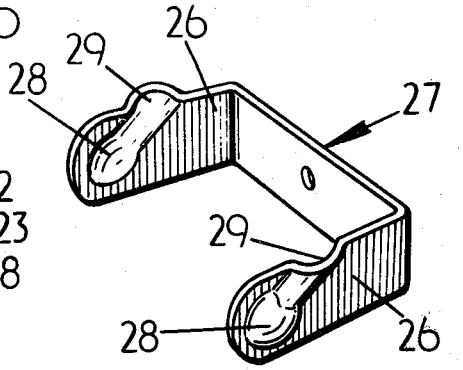
FIG. 2 is a perspective view to an enlarged scale, of the catch element of the collapsible strut system.

Referring to FIGS. 1 and 2, in this embodiment the heat sensitive release device comprises a tubular body 20 for screw-engagement in pipework, a deflector 21 axially spaced from the tubular body 20 and connected thereto by a yoke 22 (shown partially broken away). A through-flow passage traverses the tubular body 20 and is normally closed by a valve 23. The valve 23 is maintained closed by a strut 24 which forms part of a collapsible strut system which collapses when a predetermined temperature is obtained, thus permitting valve opening and delivery of a fire quenching fluid, or gas pressure release when the sprinkler forms part of a fire detection system.

The collapsible strut system additionally comprises a cylindrical heat sensitive cartridge 25, as will be described later, fitted between two wings 26 of a U-shaped catch element 27. The wings 26 of the catch element 27 have recesses 28 and lead-in channels 29 to accommodate and locate the cartridge 25 and permit fitment of the cartridge 25 into position. An angled lever 30 is riveted or screwed at one end 31 to the connecting portion between the wings 26 of the catch 27. At its other end, the lever 30 has a dimple or hole (not shown) which locates the lever 30 on a fulcrum formed by a tightening screw or crimped pin location 32 fastened to the yoke 22 of the sprinkler and which screw or pin can be used to fasten the deflector 21 to the yoke 22. As aforesaid, the strut 24 engages at one end in a groove formed in the valve 23 and at its other end the strut 24 locates in a recess in the lever 30 to one side of the fulcrum 32. Intermediate its ends, the strut 24 bears against the cartridge 25 and is held between the valve 23 and the lever 30 at an angle to the longitudinal axis of the sprinkler.

The catch element 27 (FIG. 2) is formed from a single piece of metal suitably bent to U-shape to provide the opposed wings 26, each of which is pressed to form the recesses 28 centrally of the wings 26 and the lead-in channels 29. The lead-in channels 29 facilitate positioning of the cartridge 25.

In a modification, the lever 30 can be fulcrummed on a knife edge portion formed on the yoke 22, the deflector 21 being attached to the yoke 22 by a separate screw or by spinning.

Figure 3:
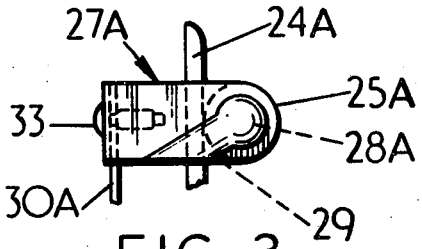
FIG. 3 is a fragmentary view of a modification of the sprinkler of FIGS. 1 and 2.

Another modification can be made to the collapsible strut system. As shown in FIG. 3 the lever 30A can be attached to the catch 27A by a rivet 33 with a pinched end which projects towards the strut 24A where it bears against the cartridge 25A. This arrangement prevents the lever 30A from being pushed towards the strut 24A so that the cartridge 25A may not be removed from the catch 27A.

Alternatively, the riveted end of the lever 30A could be curved round to form a tag projecting towards the cartridge 25A, which tag would prevent removal of the cartridge 25A from the catch element 27A.

Figure 4:
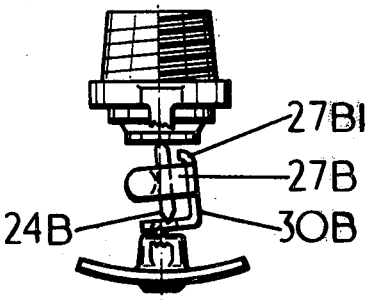
FIG. 4 is a side view showing a modified sprinkler.

In a further modification (FIG. 4), the lever 30B and the catch element 27B are integrally formed. In this modification, the absence of a rivet permits the overall height of the sprinkler to be shortened.

Again, the catch element 27B is formed with a tag 27B1 which can be considered as a continuation of the lever 30B. This tag 27B1 prevents cartridge removal from the catch 27B by movement of the lever 30B towards the strut 24B.

Figure 5:
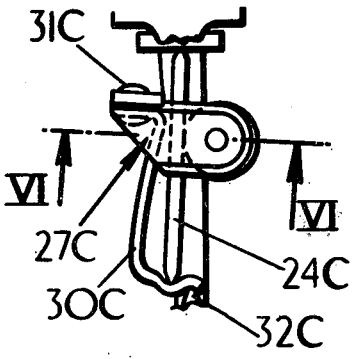
FIG. 5 and 6 are respectively a detail of a side view of another modified sprinkler and a section on the line VI—VI of FIG. 5.

FIG. 5 shows another modification of the sprinkler shown in FIG. 1. In this case the lever 30C is curved to locate the end of the strut 24C and the fulcrum 32C is formed by a screw or knife edge. The catch element 27C is again U-shaped but the lever 30C curves beneath it and is riveted thereto by a rivet 31C.

Instead of curving the lever 30C and locating it on the fulcrum 32C, a conical ended screw and recessed lever or recessed screw end and projection-ended lever may be employed.

Figure 6:
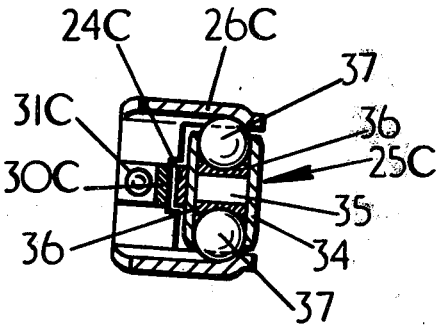

The cartridge as used in various embodiments of the invention and as shown in cross-section in FIG. 6 as at 25C, comprises a cylindrical tube 34 within which is a fusible pellet 35 and circular discs 36 which act as pressure pads and provide seating for two spheres 37 which protrude from the end of the tube 34. The discs 36 may have spherical segmental indentations, as shown, to reduce the compressive stresses applied to the spheres 37. Also as shown, the spheres 37 may be retained in the cartridge tube 34 by slightly swaging the ends of the tube 34 onto the spheres 37 at a section smaller than a sphere diameter. The pressure pads 36 may be, for example, manufactured of brass and the spheres 37 of glass.

In a modification, the spheres 37 may be replaced by cylindrical plungers having hemi-spherical, conic frustum or chamfered ends.

The cartridge may comprise a blind ended type with only one movable sphere or plunger, the outside of the blind end being configured to conform with the sphere or plunger. However, it is recognised that this latter arrangement is not as satisfactory as the arrangement described since:

(a) It does not increase the chances of the heat sensitive release device operating under adverse conditions which may cause one of the spheres or plungers to stick in the cartridge cylinder.

(b) The cartridge must be manufactured in its depth and outside length to accurate limits, which is not the case with the alternative arrangement where the cartridge tube merely contains elements which either correspond to those used with the blind tube or are easy to control dimensionally such as strip material for pressure pads and such as spheres.

The spaces around the spheres 37 and between the cartridge ends of the wings 26C may be protected from corrosion in a conventional manner by the spheres 37 being immersed in or surrounded by a fusible compound of lower melting point than the pellet 35 such as petroleum jelly, wax or mixtures of these, bitumen, greases etc.

In a modification, a projection may be provided on the central portion of the lever or strut to prevent uneven contact between the cartridge and the strut or lever.

Figure 7:
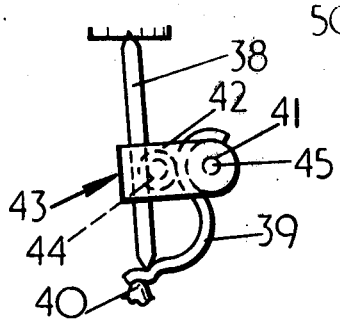
FIG. 7 is a fragmentary side view of still another modified sprinkler.

Another embodiment of collapsible strut system is shown in FIG. 7. In this embodiment, a strut 38 is again located at one end in a groove, in for example a valve or a sprinkler, and at its other end engages in a formation in a lever 39. Similarly, the lever 39 again locates at one end on a fulcrum formed by a pin or screw 40 adjacent the location of the strut 38. However, at its other end, the lever curves around and bears against a cartridge 41 held between two opposing wing portions 42 of a U-shaped catch element 43. The catch element 43 passes around the strut and a rivet 44 is fitted across the two opposite wing portions of the catch element 43 between the strut 38 and the lever 39 drawing the wing portions 42 together to a specific dimension. As before, concave recesses or holes 45 are formed in the catch element 42 to accommodate the cartridge 41.

The catch element 43, as described, can be modified. In one modification (not shown), the wings 42 can be made shorter so that the connecting portion between the wings 42 lies adjacent the lever 39 where it curves around the cartridge 41. A tab is bent outwards at an angle from the connecting portion of the catch element 43 and apertured to allow the strut 38 to pass therethrough and thereby retain the catch element 43. Alternatively, tags could be attached to the wings and bent around the strut 38 to retain the catch element 43.

Figure 8:
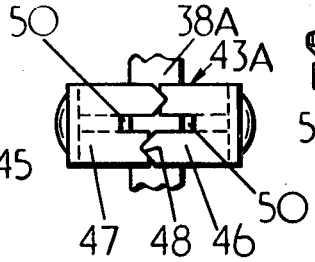
FIG. 8 shows a modified catch construction.

A further modification is shown in FIG. 8. In this case the catch element 43A is of two part construction 46 and 47. The two parts 46 and 47 have complementarily-shaped edges indicated at 48 to ensure correct relative positioning and they are secured together by, inter alia, a rivet, or screw and nut, or a pin and spring push-on self locking retaining rings. The two interconnected parts 46, 47 thus define a slot between the securement and the catch ends through which the strut 38A can pass as shown. Tags 50 are formed on the catch element 43A and lie close to the strut 38A at each side thereof for location purposes.

In yet a further modification, the cartridge can be held between two opposing wings which may form part of or may be attached to a sprinkler valve or to a fixed part of a sprinkler, for example the wings could form part of the yoke of the sprinkler. As described, the lever would again bear against the cartridge to hold the strut system in a non-collapsed condition and the cartridge would be retained by bending over tags on the wing edges. Alternatively, the cartridge could be retained by making an attachment to, or suitable deformation of, the lever end or by pegging or riveting the wings or lever end to provide an obstruction equivalent to a tag or tags.

Figure 9:
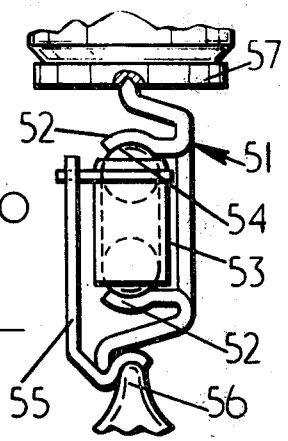
FIG. 9 is a fragmentary side view of a further modified, sprinkler.

Another embodiment or sprinkler is shown in FIG. 9 and in this embodiment it will be seen that the heat sensitive element lies substantially along the longtitudinal axis of the sprinkler.

Figure 10:
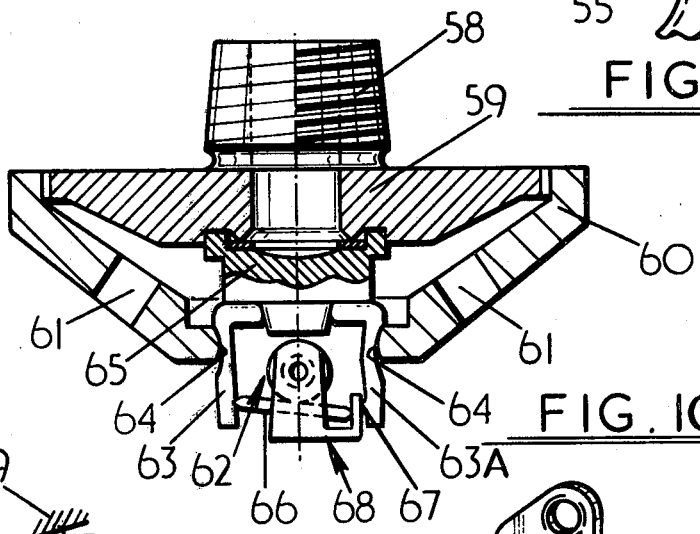
Fig. 10 is a view of an automatic sprinkler in a partial cross-section.

A strut 51 is made from a strip of material wide enough to be pierced and for two opposing wings 52 to be punched out therefrom. A heat sensitive cartridge 53 is held between the opposing wings 52, which are recessed as at 54, and one end of a lever 55 bears against the cartridge 53 exerting a sideways force thereon. The other end of the lever 55 locates on a fulcrum 56 of the sprinkler yoke (not shown) and is also shaped to locate one end of the strut 51. The other end of the strut 51 is located in a groove on a valve 57 of the sprinkler. FIG. 10 shows a further embodiment of a sprinkler, which has a tubular body 58 for screw-engagement in pipework, a flanged body 59 projecting radially from the tubular body 58, and a cover 60 attached to the flanged body 59. The cover 60 has channels and apertures 61 therein through which a fire extinguishing fluid can flow and thus forms a deflector.

The cover 60 has a central aperture 62 which locates a pair of opposed angled components 63 and 63A which are fulcrummed against the sides of the aperture 62 at a tapered portion 64 of their length. At one end, the components 63 and 63A bear against a valve 65 to maintain it closed. At their other ends the component 63 locates the end of a strut 66 and the component 63A provides a fulcrum 67 for an integral lever and catch element 68 holding a heat sensitive cartridge. The strut 66 bears against the cartridge 67.

While the embodiments of heat sensitive release device of the present invention have been described above as being automatic firefighting or detector sprinkler, they may be, alternatively, multiple spray control valves, having simple or compound link systems, fusible link systems (simple or compound) or any other appliance where there is use for such a device, and the scope of the invention disclosed and claimed herein is to be construed accordingly.

Figure 11:
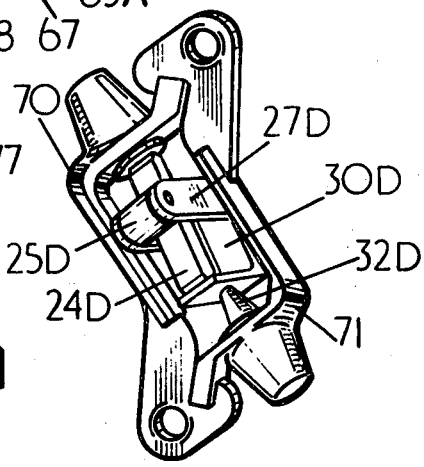
FIG. 11 is a side view of a fusible link according to the present invention.

An example of a fusible link system is shown in FIG. 11. The collapsible strut system is similar to that described with reference to FIGS. 1 and 2 and the same numerals have been used to indicate identical parts of the device but with a suffix "D". In the link the strut 24D engages in a groove on one of the arms 70 of the link and the lever 30D locates on a fulcrum 32D fixed to the other arm 71 of the link. The link holds the collapsible strut system under compression so that when a predetermined temperature is attained, the cartridge 25D permits the strut 24D to move out of position in the catch element 27D to collapse the strut system and hence separate the two arms 70 and 71 of the link.

In a modification the wings of the catch element may be integral with the arms of the link, one on each arm.

In all the embodiments so far described, a heat sensitive cartridge is used to provide an element sensitive to a predetermined temperature above which collapse of the strut system is required. When the predetermined temperature is attained, the fusible pellet within the cartridge melts permitting the sphere or spheres to move inwardly of the cartridge tube. The component of the collapsible strut system bearing against the cartridge is thereby released so that the collapsible strut system can collapse, for example, to open a valve of a sprinkler.

However, it will be realised that many other types of heat sensitive element could be used in the embodiments of the invention described in place of the cartridge. For example, a strip of a heat sensitive metal alloy could be used, in any of the collapsible strut systems described. Such a strip would convert heat energy supplied to it to mechanical energy and thereby change its shape to a predetermined shape. Metal alloys suitable for this purpose comprise nickel-titanium alloys known as 55-Nitinol alloys which are heat treated so as to return to a predetermined shape on subsequent heating.

Thus it will be realised that various heat sensitive elements can be used in place of the cartridge element described above with reference to the drawings.

It is also envisaged in the embodiments of heat sensitive release device described that the lever could be a spring lever which provides more rapid separation of the components of the collapsible strut system.

Alternatively, flexibility may be provided in the collapsible strut system by positioning spring washers (Belville washers) in, for example, a sprinkler assembly, or in a half link, or by fitting a compression spring in the yoke, valve, half link system or control lever depending into which article the heat sensitive release device is incorporated. The spring action may alternatively be provided by manufacturing the sprinkler yoke of flexible material, or by so shaping it as a beam to give greater than normal flexibility. This may similarly be achieved by suitable design of the half links of a fusible link, or by suitable design of the lever and/or yoke of a control valve. A further advantage of providing flexibility in the strut system is to reduce variation in the load transmitted to the cartridge so that creep of the fusible pellet will not be caused by over-loading resulting from dimensional errors.

Figure 12:
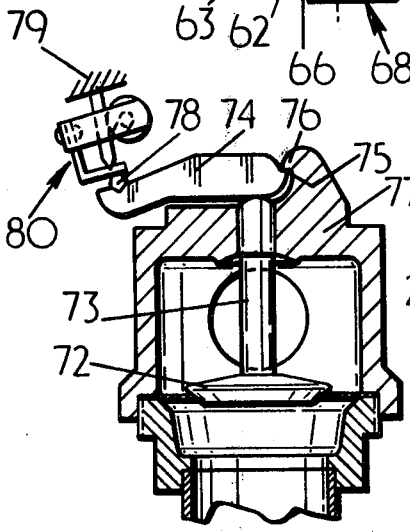
FIG. 12 is a sectional view of a multi-spray control valve according to the invention.

Reference is now made to FIG. 12 which shows a conventional multi-spray control valve embodying a collapsible strut system according to the present invention. The valve has a movable stemmed valve member 72, whereof the stem 73 is acted upon by a lever 74 to maintain the valve member 72 in closed position.

The lever 74 has a nose 75 at one end engagable under a projection 76 integral with the valve body 77. The other end of lever 74 is acted upon by the collapsible strut system compressed between a fulcrum lever 74 and a stationary structural component 79. The strut system 80 is as described with reference to FIGS. 1 and 2.

The heat sensitive release device of whatever construction may, if desired, be triggered electrically. For this purpose a flange may be formed on the cartridge body and a one-shot actuator disposed in close proximity thereto so that, on operation of the latter, the flange is struck causing the components of the collapsible strut system to fly apart. The actuator, in the case of a sprinkler for example, may be mounted on the yoke adjacent the cartridge.

What is claimed is:

1. A heat sensitive release device comprising first and second relatively movable components, and a normally stable strut system located between the components to retain them in fixed positions relative to each other but collapsible on attainment of a predetermined temperature, the strut system comprising:

(a) a heat sensitive element, (b) a catch element having opposed wings between which the heat sensitive element is retained, (c) a lever fulcrummed on the first component and joined to the catch element, (d) a strut engaging at one end on the lever adjacent the fulcrum and at its other end on the second component and bearing against the heat sensitive element to retain the lever and thereby the strut system in a stable condition, and (e) an impediment joined to the strut system and disposed between the lever and the strut to prevent lever movement towards the strut and removal of the heat sensitive element from the catch element, whereby on attainment of the predetermined temperature the heat sensitive element disengages from the wings of the catch element and permits the lever to pivot about the fulcrum to disengage the strut from the second component which together with the first component are both freed for relative movement.

2. A heat sensitive release device as claimed in claim 1, in which the impediment is a member carried by the catch element and directed towards the strut.

3. A heat sensitive release device as claimed in claim 1, in which the impediment is a member carried by the lever and directed towards the strut.

4. A heat sensitive release device as claimed in claim 1, in the form of an automatic sprinkler and in which one of the first and second components is a movable valve member of the sprinkler while the other is a yoke of the sprinkler.

5. A sprinkler as claimed in claim 4, in which a deflector is joined to the yoke of the sprinkler.

6. A sprinkler as claimed in claim 4, in which the catch element is substantially U-shaped, whereof the wings are formed with locating formations for receiving the ends of the heat sensitive element.

7. A sprinkler as claimed in claim 4, in which the lever is integral with the catch element and is configured to provide the opposed wings between which the heat sensitive element is retained.

* * * * *